US007452097B1

(12) United States Patent
Dunbar

(10) Patent No.: US 7,452,097 B1
(45) Date of Patent: Nov. 18, 2008

(54) ILLUMINATING NAIL SCISSORS

(76) Inventor: Teresa E. Dunbar, 14068 Eagle Chase Cir., Chantilly, VA (US) 20151

( * ) Notice: Subject to any disclaimer, the term of this patent is extended or adjusted under 35 U.S.C. 154(b) by 0 days.

(21) Appl. No.: 11/553,057

(22) Filed: Oct. 26, 2006

(51) Int. Cl.
*B25B 23/18* (2006.01)

(52) U.S. Cl. ..... 362/119; 362/109

(58) Field of Classification Search ..... 362/119, 362/109; 30/1, 123
See application file for complete search history.

(56) References Cited

U.S. PATENT DOCUMENTS

| | | | | |
|---|---|---|---|---|
| 3,325,897 | A * | 6/1967 | Luebkeman | 30/254 |
| 4,250,620 | A | 2/1981 | Nishikawa | |
| D344,225 | S | 2/1994 | Hendon et al. | |
| 5,467,256 | A | 11/1995 | Chen | |
| 5,678,919 | A | 10/1997 | Huang | |
| 5,727,319 | A | 3/1998 | Myerchin et al. | |
| D506,661 | S | 6/2005 | Phillips et al. | |
| 7,200,885 | B1 * | 4/2007 | Thomas | 7/158 |
| 7,263,775 | B2 * | 9/2007 | Moulton, III | 30/29 |
| 2005/0276039 | A1 * | 12/2005 | Hillenbrand | 362/120 |
| 2007/0019309 | A1 * | 1/2007 | Neal et al. | 359/844 |

* cited by examiner

*Primary Examiner*—Hargobind S Sawhney
(74) *Attorney, Agent, or Firm*—Advantia Law Group; Michael W. Starkweather; Jason P. Webb

(57) ABSTRACT

Illuminating nail scissors for trimming nails of infants and toddlers. There is: nail scissors, including: a first cutting member, having: a first handle portion; and a first blade portion; and a second cutting member, having: a second handle portion; and a second blade portion, wherein the first blade portion and the second blade portion have rounded blunt tips; a light module, coupled to the nail scissors; and a power module, in communication with the light module. The first handle portion and the second handle portion comprise rubber. The light module comprises an LED light. The power module comprises a lithium battery. There is also: a control module, in communication with the power module. The control module comprises an On/Off button.

10 Claims, 2 Drawing Sheets

ILLUMINATING NAIL SCISSORS

BACKGROUND OF THE INVENTION

1. Field of the Invention

The present invention relates to nail scissors, specifically illuminating nail scissors.

2. Description of the Related Art

In the related art, it has been known to use nail scissors to trim nails of infants and/or toddlers. It is important to keep the nails of infants and/or toddlers short because they lack muscle control and can easily scratch themselves. It is also important to keep the nails of infants and/or toddlers short because they may scratch others whom they interact with. As a result, some infants and/or toddlers may need to have their nails trimmed as often as once a week.

However, it is difficult to trim nails of infants and/or toddlers because infants and/or toddlers have extremely small fingernails and/or toenails, because infants and/or toddlers have a tendency to squirm. Accordingly, nail scissors for trimming nails of infants and/or toddlers are often: limited in use, difficult to use, unsafe, and/or difficult to grip. Some improvements have been made in the field. Examples include but are not limited to the references described below, which references are incorporated by reference herein:

U.S. Pat. No. 5,678,919, issued to Huang, discloses illuminating scissors including a pair of blades pivotally joined in an intermediate portion thereof by a bolt engaged with a hexagonal lock nut and each having a handle at an end thereof, a cylindrical housing mounted on one of the blades, a light bulb arranged in a cylindrical edge of the cylindrical housing, a battery fitted in the cylindrical housing and electrically connected with the light bulb, and a button mounted on the cylindrical housing and electrically connected with the batter and the light bulb, and a linking rod having a first end connected with the housing and second end with one of the blades, whereby the illuminating scissors will direct light onto the cutting surface.

U.S. Pat. No. 5,727,319, issued to Myerchin et al., discloses a pocketknife with integral light includes a hollow handle and a cutting blade pivotally connected thereto. The hollow handle at its forward end includes an open compartment containing a battery, connected to an illumination pathway containing an LED electrically connected to the battery. A belt clip covers the open compartment and includes a push button adapted to button the LED on and off. The open compartment and the illumination pathway are sealed to resist moisture and dust from reaching the electrical components. The light from the LED is directed at the tip of a serrated edge of the cutting blade.

U.S. Pat. No. 5,467,256, issued to Chen, discloses a knife with a lighting fixture which mainly consists of a pair of cases, a pivotally turnable knife, and a pivotally turnable supporting plate. The supporting plate has a cell, a bulb, and a push button supported thereon. The push button is slightly projected from one of the case so that a depression of it may lighten the bulb to shine toward the knife for use in a dark place. The supporting plate may be turned out of the cases for mounting a new cell and/or a new bulb when necessary.

U.S. Pat. No. 4,250,620, issued to Nishikawa, discloses safety scissors wherein the scissor members are composed of a metal member partially embedded in plastic in such a way that a part of the exposed metal serves as a cutting edge and the remaining exposed portion of the metal member bears the sliding friction when the two scissor members are moved relative to each other.

U.S. Design Pat. No. D506,661, issued to Phillips et al., discloses an ornamental design for scissors.

U.S. Pat. No. Des. 344,225, issued to Hendon et al., discloses an ornamental design for children's scissors.

The inventions heretofore known suffer from a number of disadvantages, which include: being limited in use, being difficult to use, being unsafe, and or being difficult to grip.

What is needed is illuminating nail scissors that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available nail scissors. Accordingly, the present invention has been developed to provide illuminating nail scissors.

In one embodiment of the invention, there is illuminating nail scissors for trimming nails of infants and/or toddlers, including: nail scissors, including: a first cutting member, having: a first handle portion, disposed at a first end of the nail scissors; and/or a first blade portion, disposed at a second end of the nail scissors; and/or a second cutting member, pivotally coupled to the first cutting member, having: a second handle portion, disposed at the first end of the nail scissors; and/or a second blade portion, disposed at the second end of the nail scissors, wherein the first blade portion and/or the second blade portion may have rounded blunt tips. In another embodiment of the invention, the illuminating nail scissors includes a light module, coupled to the nail scissors, and/or configured to provide light. In still another embodiment of the invention, the illuminating nail scissors includes a power module, in communication with the light module, and/or configured to provide power.

In a further embodiment of the invention, the first handle portion and/or the second handle portion may be rubber. In still a further embodiment of the invention, the light module may be an LED light. In yet a further embodiment of the invention, the power module may be a lithium battery. In still yet a further embodiment of the invention, the illuminating scissors includes: a control module, in communication with the power module, and/or configured to control distribution of power from the power module to the light module. In even a further embodiment of the invention, the control module may be an On/Off button.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
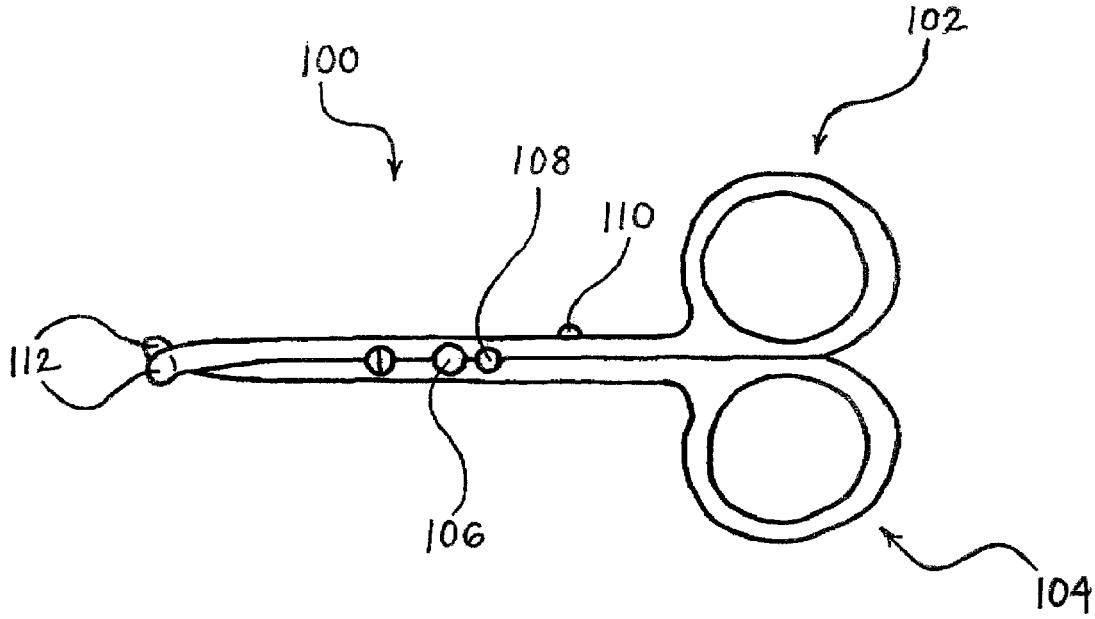
FIG. 1 is a top plan view of illuminating nail scissors, according to one embodiment of the invention.
Figure 2:
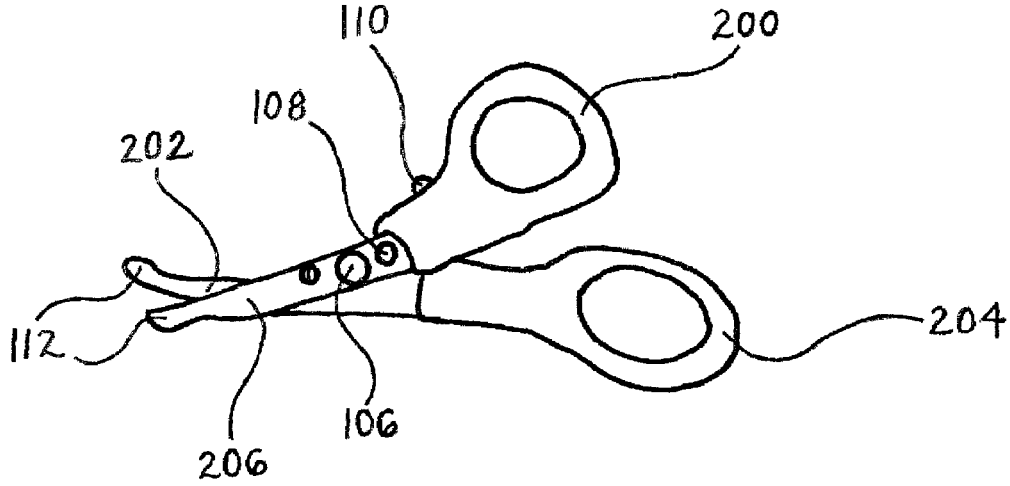
FIG. 2 is a side perspective view of illuminating nail scissors, according to one embodiment of the invention.
Figure 3:
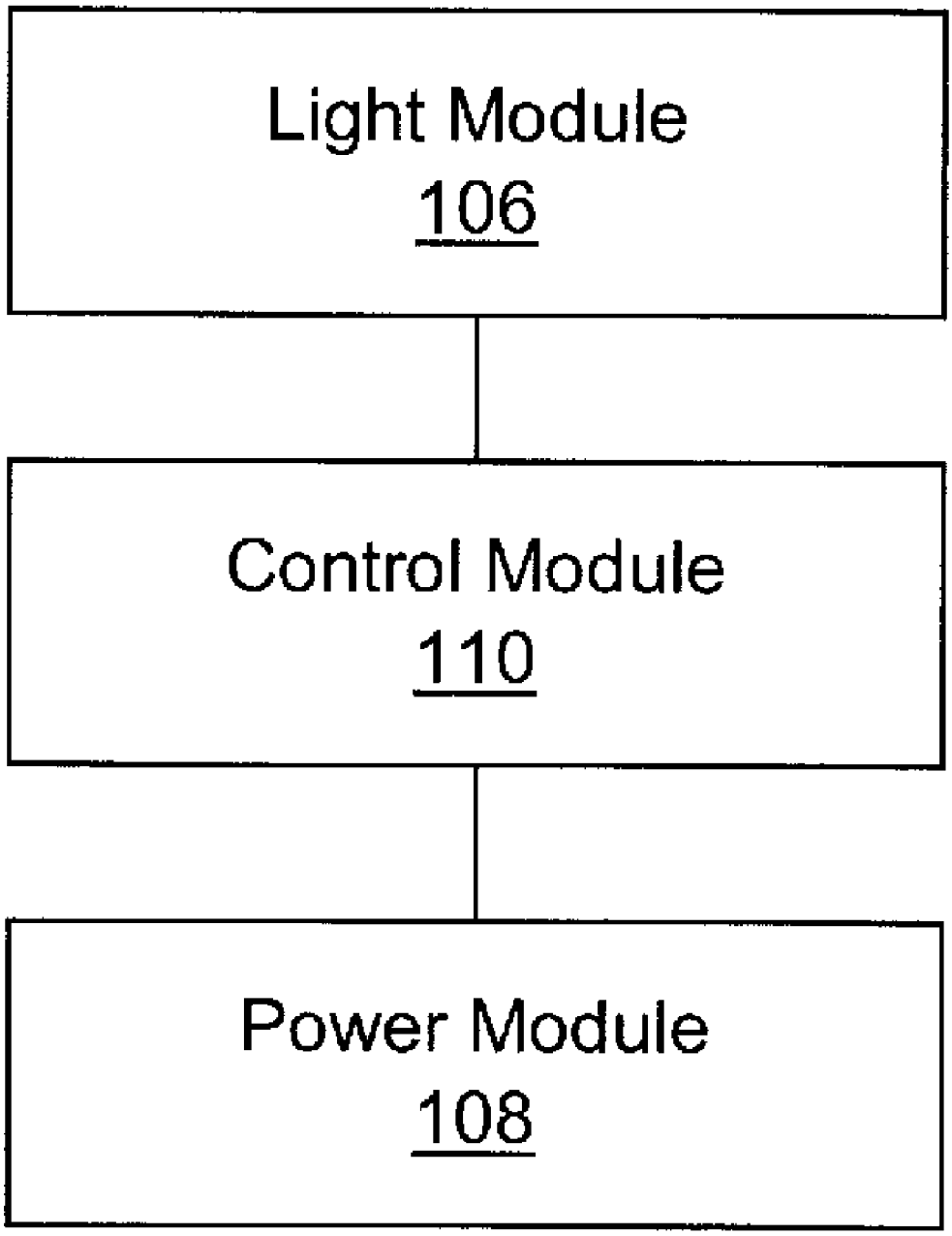

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is, are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Looking to the Figures, there is an illuminating nails scissors for trimming nails of infants and toddlers. As illustrated, the illuminating nail scissors includes: nail scissors 100, a light module 106, a power module 108, and a control module 110. In one embodiment of the invention, the light module 106 may be a light emitting diode (LED) light, such as T1 LED Light by The LED Light, Inc., of Carson City, Nev. In another embodiment of the invention, the power module 108 may be a lithium battery, such as the Mustang Raymax Lithium Battery by Zhejiang Mustang Battery Co., Ltd., of Zhejiang, China. In an additional embodiment of the invention, the control module 110 may be an On/Off button.

Also, as shown in the Figures, the nail scissors 100 has a first cutting member 102 and a second cutting member 104. In addition, the first cutting member 102 has a first handle portion 200 and a first blade portion 202, and the second cutting member 104 has a second handle portion 204 and a second blade portion 206. As illustrated, the first handle portion 200 and the second handle portion 204 are disposed at a first end 208 of the nail scissors 100, and the second handle portion 204 and the second blade portion 206 are disposed at a second end 210 of the nail scissors 100.

Additionally, illustrated by the Figures, the first blade portion 202 and the second blade portion 206 have rounded, blunt tips 112, enabling a user to safely trim an infant's or toddler's nails by preventing inaccurate cuts. Further, the first handle portion 200 and the second handle portion 204 may comprise rubber, enabling a user with more control when using the nail scissors 100 by preventing slipping. In operation, the illuminating nail scissors enable a user to illuminate and safely trim nails, even in locations with inadequate ambient lighting.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the blade portions 204, 206 as shown have rounded, blunt tips 112, it is envisioned that the tips 112 could have any shape, such as pointed, and/or be sharp.

Additionally, although the figures illustrate the blade portions 202, 206 as curved, enabling the nails scissors 100 to follow the curve of a nail and/or prevent jagged-edged nails, the blade portions 202, 206 could be substantially planar.

It is also envisioned that the light module 106, power module 108, and control module 110, could be disposed anywhere on the nail scissors 100 enabling a user to view a nail to be trimmed. As non-limiting examples, the modules 106, 108, 110 could be disposed on: the first handle portion 200; the first blade portion 202; the second handle portion 204; the second blade portion 206; a top side of the nails scissors 100; and/or a bottom side of the nail scissors 100.

It is expected that there could be numerous variations of the design of this invention. An example is that the nail scissors 100 could have any sizes and/or shapes known in the art. As one non-limiting example, the cutting members 102, 104 could be four inches long, and the handles 200, 204 could be two inches wide.

Finally, it is envisioned that the components of the device may be constructed of a variety of materials. For example, the illuminating nail scissors may be constructed from: metal, such as stainless steel; glass; rubber; plastic, etc., and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. Illuminating nail scissors for trimming nails of infants and toddlers, comprising:

a) nail scissors, including:

a1) a first cutting member, having:

a1A) a first handle portion, disposed at a first end of the nail scissors; and a1B) a first blade portion, disposed at a second end of the nail scissors; and a2) a second cutting member, pivotally coupled to the first cutting member, having:

a2A) a second handle portion, disposed at the first end of the nail scissors; and a2B) a second blade portion, disposed at the second end of the nail scissors, wherein the first blade portion and the second blade portion have rounded blunt tips, and wherein the first and second blade portions of the cutting members are curved away from the plane of the handle portions;

b) a light module, coupled to the nail scissors, and configured to provide light; and c) a power module, in communication with the light module, and configured to provide power.

2. The illuminating nail scissors of claim 1, wherein the first handle portion and the second handle portion comprise rubber.

3. The illuminating nail scissors of claim 2, wherein the light module comprises an LED light.

4. The illuminating nail scissors of claim 3, wherein the power module comprises a lithium battery.

5. The illuminating nail scissors of claim 4, further comprising:

a) a control module, in communication with the power module, and configured to control distribution of power from the power module to the light module.

6. The illuminating nail scissors of claim 5, wherein the control module comprises an On/Off switch.

7. Illuminating nail scissors for trimming nails of infants and toddlers, consisting essentially of:

a) nail scissors, including:

a1) a first cutting member, having:

a1A) a first handle portion, disposed at a first end of the nail scissors; and a1B) a first blade portion, disposed at a second end of the nail scissors; and a2) a second cutting member, pivotally coupled to the first cutting member, having:

a2A) a second handle portion, disposed at the first end of the nail scissors; and a2B) a second blade portion, disposed at the second end of the nail scissors, wherein the first blade portion and the second blade portion have rounded blunt tips, and wherein the first and second blade portions of the cutting members are curved away from the plane of the handle portions;

b) a light module, coupled to the nail scissors, and configured to provide light; and c) a power module, in communication with the light module, and configured to provide power.

8. The illuminating nail scissors of claim 7, wherein the first handle portion and the second handle portion comprise rubber.

9. The illuminating nail scissors of claim 8, wherein the light module comprises an LED light.

10. The illuminating nail scissors of claim 9, wherein the power module comprises a lithium battery.

* * * * *